US005974915A

United States Patent [19]

Chou

[11] Patent Number: 5,974,915

[45] Date of Patent: Nov. 2, 1999

[54] RATCHET SCREW DRIVER

[76] Inventor: Mei Chu Chou, No. 240-3, Peng Yii Road, Tai Ping City. Taichung Hsien, Taiwan

[21] Appl. No.: 09/097,452

[22] Filed: Jun. 15, 1998

[51] Int. Cl.[6] ..... B25B 13/46

[52] U.S. Cl. ..... 81/63.1; 81/58; 192/43.2

[58] Field of Search ..... 81/58, 60, 63.1; 192/43.2

[56] References Cited

U.S. PATENT DOCUMENTS 2,720,296 10/1955 Briglia ..... 81/63.1
5,575,192 11/1996 Eggert ..... 81/63.1
5,582,081 12/1996 Lin ..... 81/63.1
5,685,204 11/1997 Braun ..... 81/63.1
5,687,820 11/1997 Lin ..... 81/63.1

*Primary Examiner*—David A. Scherbel
*Assistant Examiner*—David B. Thomas

[57] ABSTRACT

A ratchet driving mechanism includes a gear rotatably engaged in a housing. A pair of pawls are disposed in the opening and biased to engage with the gear by a U-shaped spring member. A pair of partitions are engaged with the gear and the spring member and the pawls for retaining the elements in place. A control ferrule is rotatably secured to the housing and includes a plate having an actuator extended between the pawls for acting on the pawls and for controlling the driving directions of the gear. The U-shaped spring member may be easily engaged into the housing.

2 Claims, 5 Drawing Sheets

RATCHET SCREW DRIVER

BACKGROUND OF THE INVENTION

1. Field of the Invention

The present invention relates to a screw driver, and more particularly to a ratchet screw driver.

2. Description of the Prior Art

Various kinds of typical ratchet screw drivers have been developed and widely used. Most of the ratchet screw drivers comprise a pair of pawls and two or more resilient members for acting onto the pawls and for biasing the pawls to engage with a ratchet gear. However, the two or more resilient members may not be easily engaged into and assembled in the handle of the screw driver which includes only a small space for receiving the elements.

The present invention has arisen to mitigate and/or obviate the afore-described disadvantages of the conventional ratchet screw drivers.

SUMMARY OF THE INVENTION

The primary objective of the present invention is to provide a ratchet screw driver having a greatly simplified configuration for allowing the ratchet screw driver to be easily assembled.

In accordance with one aspect of the invention, there is provided a ratchet driving mechanism comprising a housing including an opening formed therein, a rod rotatably secured in the housing and including a gear secured thereon, a pair of pawls disposed in the opening of the housing for engaging with the gear of the rod, a U-shaped spring member engaged in the opening of the housing and engaged on the gear and including a pair of leg elements engaged with the pawls for biasing the pawls to engage with the gear, a pair of partitions secured in the opening of the housing and each including a notch rotatably receiving the rod, the partitions being engaged with the gear and the spring member and the pawls for retaining the spring member and the pawls in place relative to the gear, a control ferrule rotatably secured to the housing, and a plate secured to the control ferrule and rotated in concert with the control ferrule, the plate including an actuator extended inward of the opening of the housing and extended between the pawls for allowing the actuator to act on the pawls respectively when the actuator is rotated by the control ferrule. The gear is allowed to rotate freely relative to the housing in one direction and allowed to rotate and to drive the housing in a reverse direction via a first of the pawls when a second of the pawls is actuated by the actuator and disengaged from gear. The U-shaped spring member and the partitions and the pawls may be easily engaged into the opening for allowing the ratchet driving mechanism to be easily assembled.

The plate includes three cavities, the housing includes a spring-biased projection engaged with the cavities for positioning the control ferrule and the plate to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
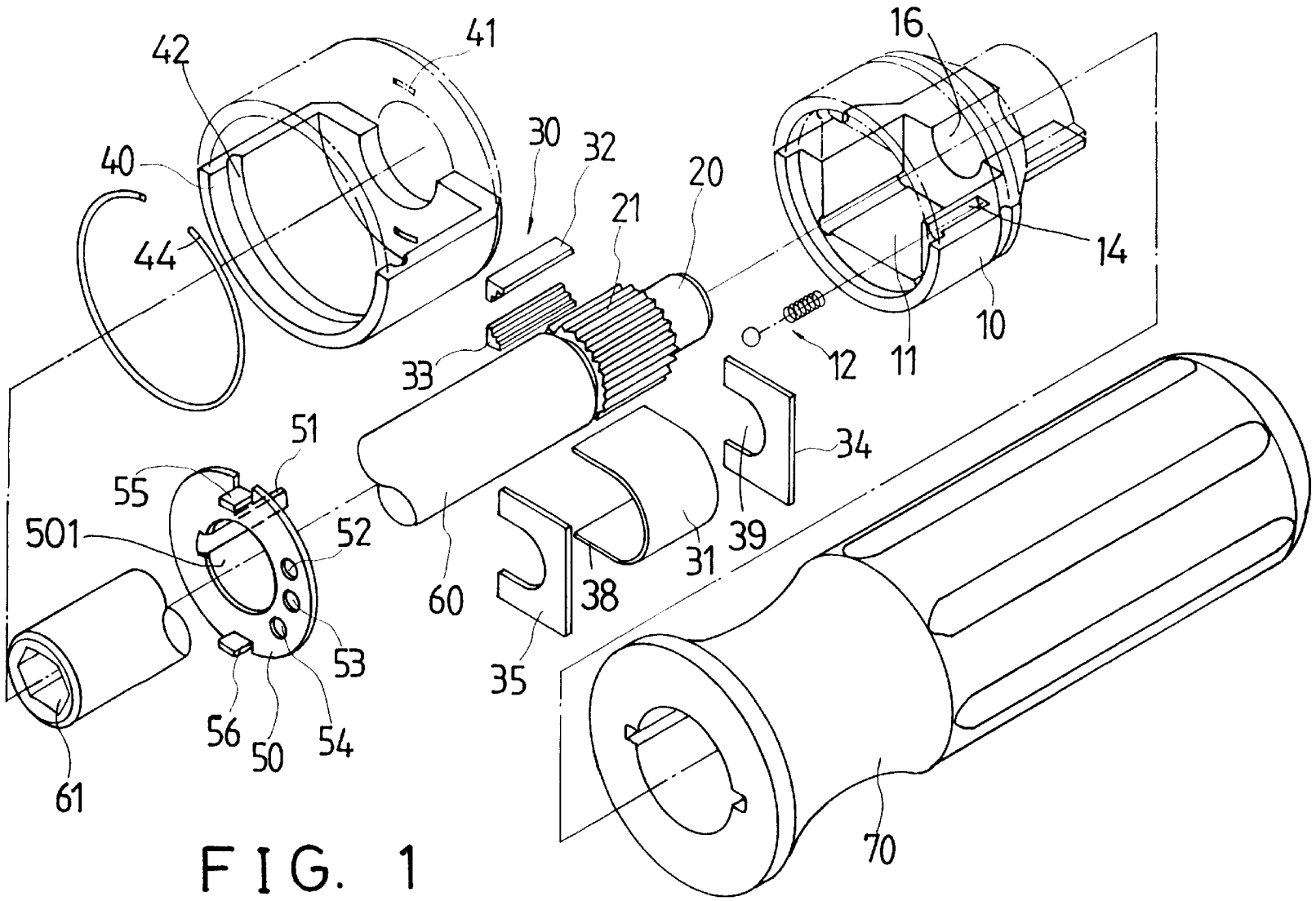
FIG. 1 is an exploded view of a ratchet screw driver in accordance with the present invention.
Figure 2:
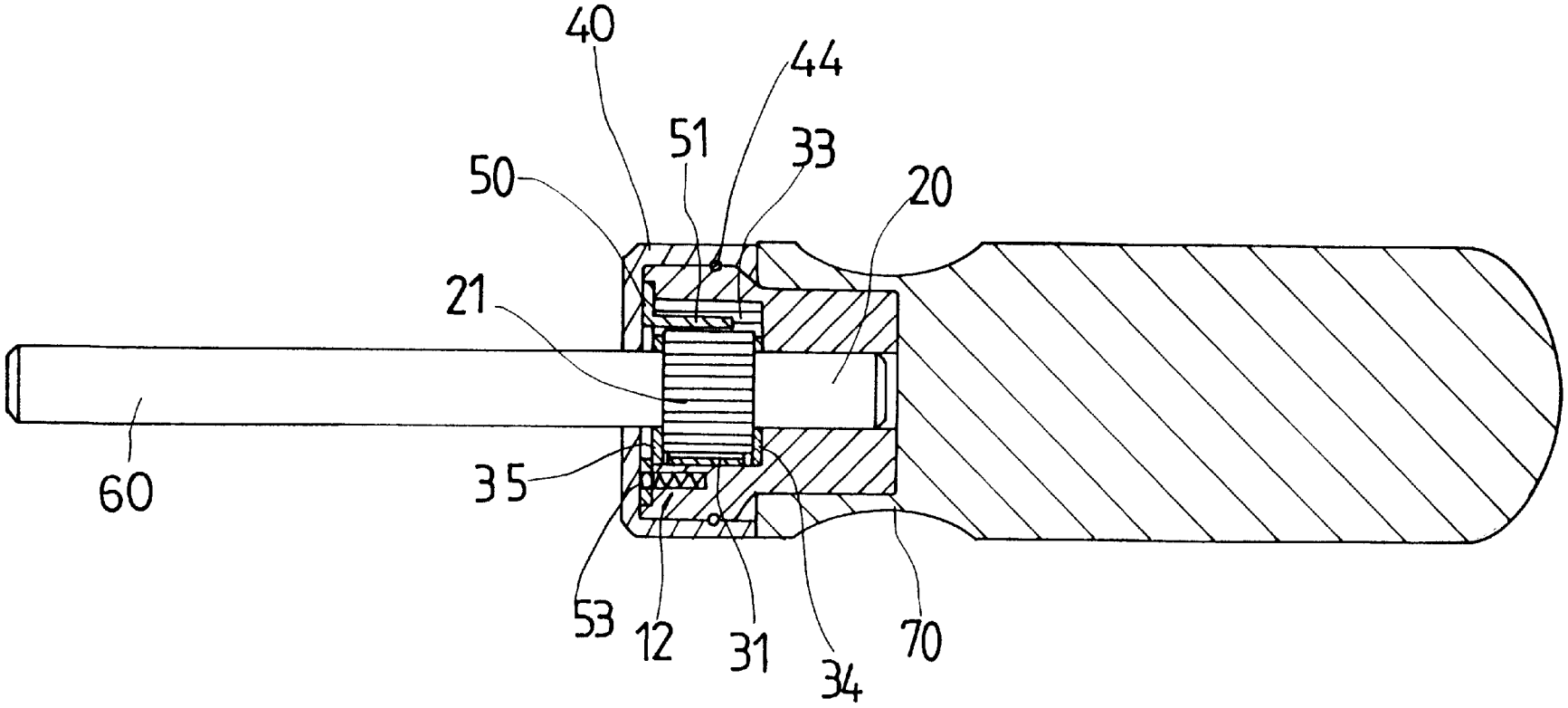
FIG. 2 is a cross sectional view taken along lines 2—2 of FIG. 3.
Figures 3, 4, 5:
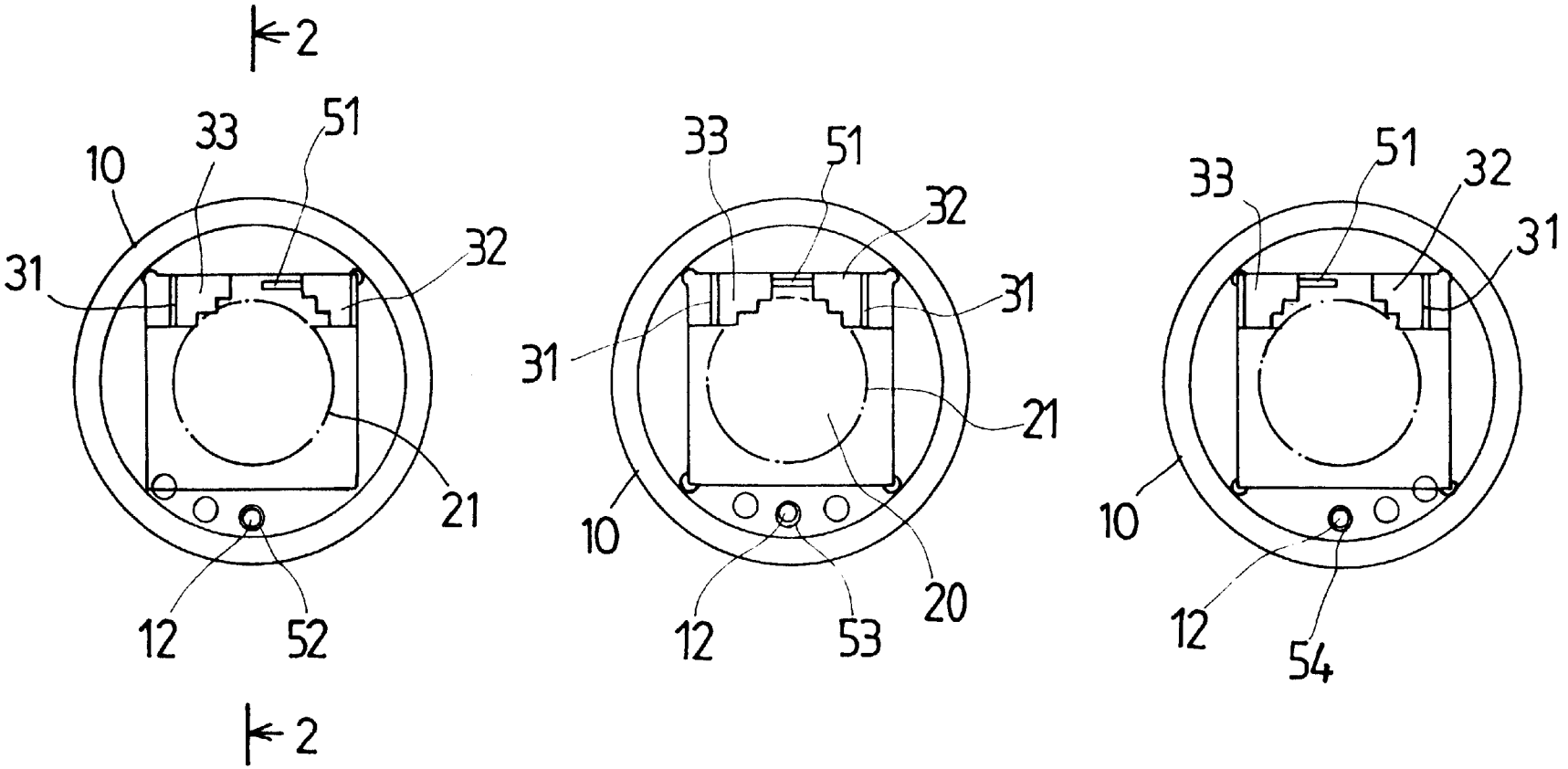
FIGS. 3, 4, 5 are plan views of the ratchet screw driver, illustrating the operation of the screw driver, in which the control ferrule is removed for showing the inner structure of the screw driver.

Referring to the drawings, and initially to FIGS. 1–3, a ratchet screw driver in accordance with the present invention comprises a housing 10 including an opening 11 formed in the front portion and having a square cross section, best shown in FIGS. 3–5, and including a spring-biased projection 12 disposed in a hole 14 that is formed in the peripheral portion of the housing 10, and including a bore 16 for rotatably receiving a rod 20. The rod 20 includes a gear 21, such as a ratchet gear, secured thereon and rotatably received in the opening 11 of the housing 10. The rod 20 includes a stem 60 extended forward therefrom and having an engaging hole 61 for engaging with a fastener or a tool bit or a coupling extension. The housing 10 may be secured in the front portion of a handle 70 of a screw driver.

A ratchet control mechanism 30 includes a pair of pawls 32, 33 disposed in the opening 11 of the housing 10. A spring member 31 is engaged on the gear 21 and is U-shaped and having two spring leg elements 38 engaged with the pawls 32, 33 for biasing the pawls 32, 33 to engage with the gear 21. Two partitions 34, 35 are engaged in the opening 11 and each includes a notch 39 for rotatably receiving the rod 20. The partitions 34, 35 are engaged with the gear 21 and the spring member 31 for positioning the spring member 31 relative to the gear 21 and for preventing the spring member 31 from being disengaged from the gear 21.

A plate 50 includes a hole 501 for rotatably receiving the rod 20 or the extension 60 of the rod 20 and includes an actuator 51 extended inward of the opening 11 and extended between the pawls 32, 33 for moving the pawls 32, 33 against the spring member 31 and for disengaging the respective pawls 32, 33 from the gear 21 (FIGS. 3, 5). The plate 50 includes three cavities 52, 53, 54 for receiving the spring-biased projection 12 and for positioning the plate 50 relative to the housing 10 and thus the handle 70. The plate 50 includes a pair of ears 55, 56 extended forward for engaging with two punctures 41 of a control ferrule 40 and for allowing the plate 50 to be rotated by the control ferrule 40. A clamping ring 44 is engaged with an annular groove 42 of the control ferrule 40 and engaged with the housing 10 (FIG. 2) for rotatably securing the control ferrule 40 to the housing 10, and for allowing the plate 50 to be rotated by the control ferrule 40.

In operation, as shown in FIG. 4, when the actuator 51 of the plate 50 is not engaged with the pawls 32, 33 and when the spring-biased projection 12 is engaged with the middle cavity 53, both the pawls 32, 33 are engaged with the gear 21, such that the gear 21 and the rod 20 and the extension 60 may not be rotated at this moment. When the pawl 32 is disengaged from the gear 20 by the actuator 51 and by rotating the control ferrule 40, as shown in FIG. 3, and when the rod 20 and the gear 21 are rotated clockwise, the housing 10 may be rotated clockwise by the rod 20 and the gear 21. When the gear 21 is rotated counterclockwise, the pawl 33 may be moved against the spring member 31 such that the gear 21 may be rotated counterclockwise relative to the housing 10 and such that the housing 10 may not be rotated counterclockwise by the gear 21. At this moment, the spring-biased projection 12 is engaged with the cavity 52 for positioning the body 10 relative to the plate 50 and the control ferrule 40.

On the contrary, when the pawl 33 is disengaged from the gear 20 by the actuator 51, as shown in FIG. 4, and when the rod 20 and the gear 21 are rotated counterclockwise, the housing 10 may be rotated counterclockwise by the rod 20 and the gear 21. When the gear 21 is rotated clockwise, the pawl 32 may be moved against the spring member 31 such that the gear 21 may be rotated clockwise relative to the housing 10 and such that the housing 10 may not be rotated clockwise by the gear 21. At this moment, the spring-biased projection 12 is engaged with the cavity 54 for positioning the body 10 relative to the plate 50 and the control ferrule 40.

It is to be noted that the spring member 31 is U-shaped which may be easily engaged into the opening 11 of the housing 10 for allowing the screw driver to be easily assembled.

Figure 7:
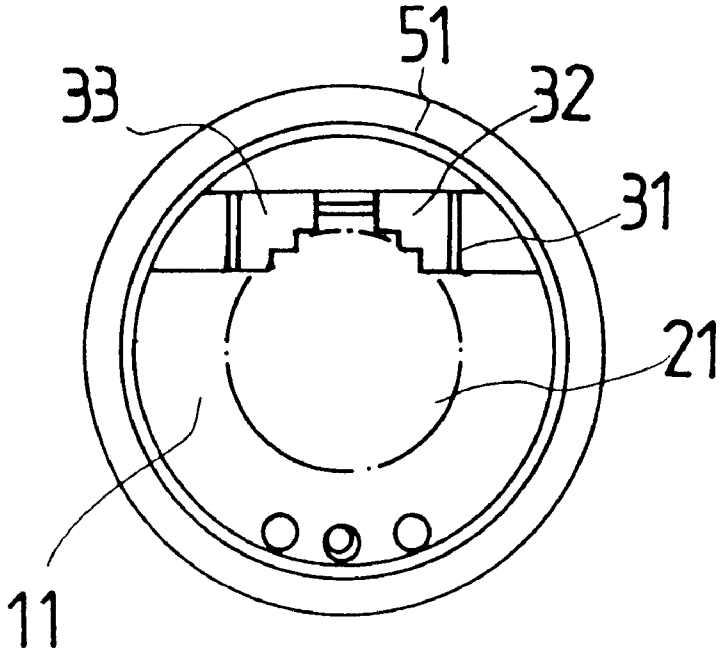
FIGS. 6, 7 are plan views illustrating the other applications of the ratchet screw driver.
Figure 6:
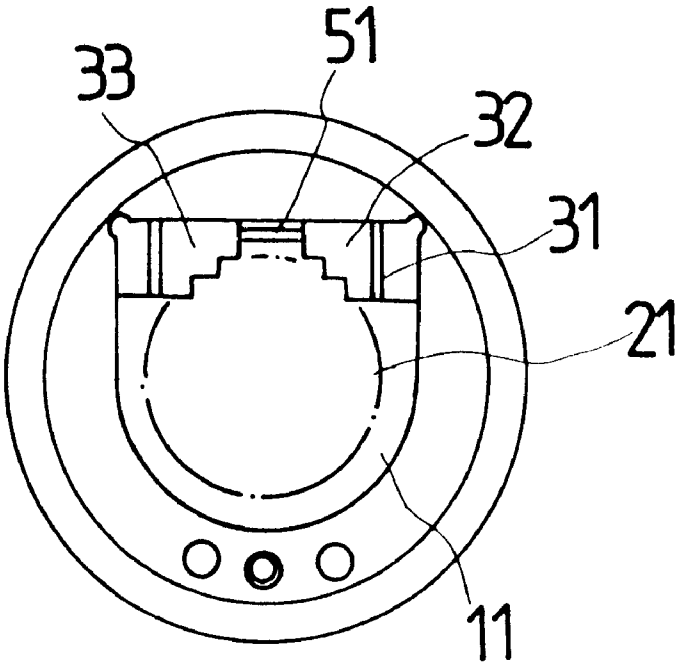

Referring next to FIGS. 6 and 7, alternatively, the opening 11 may include shapes other than the square opening. The pawls 32, 33 may also be biased to engage with the gear 21 by the spring member 31.

Figure 8:
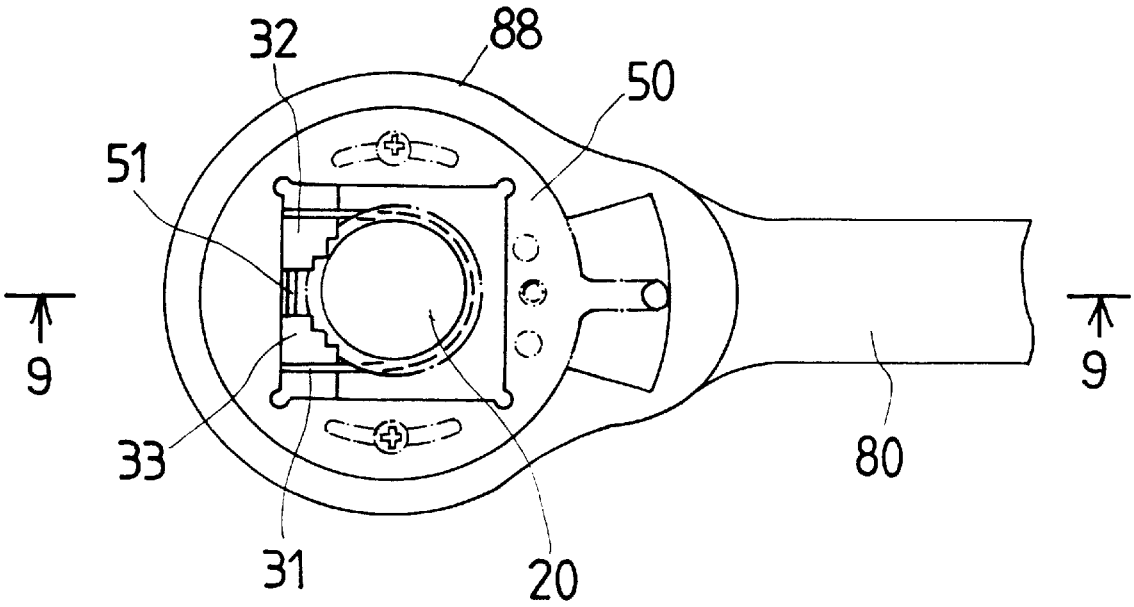
FIG. 8 is an upper plan view illustrating a further application of the ratchet screw.
Figure 9:
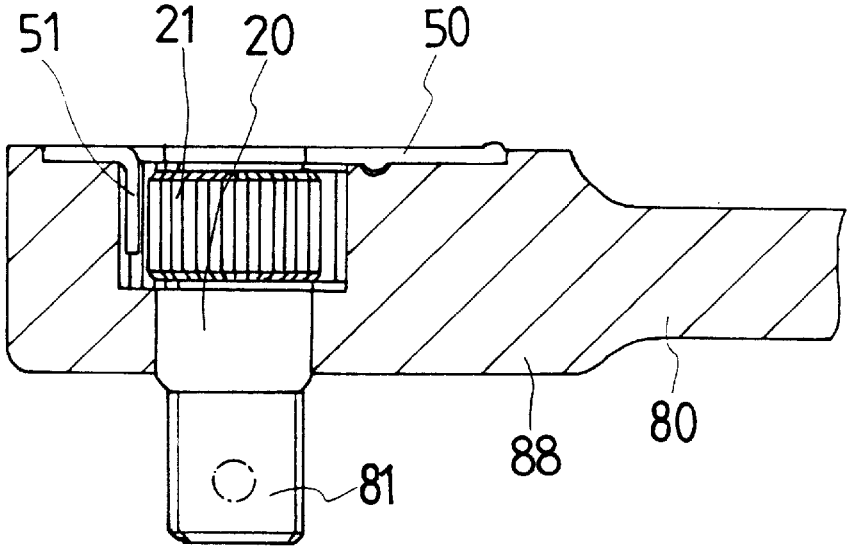
FIG. 9 is a cross sectional view taken along lines 9—9 of FIG. 8.

Referring next to FIGS. 8 and 9, the ratchet control mechanism in accordance with the present invention may also be engaged in a head 88 of a wrench 80 for providing a ratchet mechanism to the wrench 80. The rod 20 may include a driving stem 81 extended outward of the head 88 for driving purposes.

Accordingly, the ratchet screw driver in accordance with the present invention includes a greatly simplified configuration for allowing the ratchet screw driver to be easily assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ratchet driving mechanism comprising:

a housing including an opening formed therein, a rod rotatably secured in said housing and including a gear secured thereon, a pair of pawls disposed in said opening of said housing for engaging with said gear of said rod, a U-shaped spring member engaged in said opening of said housing and engaged on said gear and including a pair of leg elements engaged with said pawls for biasing said pawls to engage with said gear, a pair of partitions secured in said opening of said housing and each including a notch rotatably receiving said rod, said partitions being engaged with said gear and said spring member and said pawls for retaining said spring member and said pawls in place relative to said gear, a control ferrule rotatably secured to said housing, and a plate secured to said control ferrule and rotated in concert with said control ferrule, said plate including an actuator extended inward of said opening of said housing and extended between said pawls for allowing said actuator to act on said pawls respectively when said actuator is rotated by said control ferrule, said gear being allowed to rotate freely relative to said housing in one direction and being allowed to rotate and to drive said housing in a reverse direction via a first of said pawls when a second of said pawls is actuated by said actuator and disengaged from said gear.

2. The ratchet driving mechanism according to claim 1, wherein said plate includes three cavities, said housing includes a spring-biased projection engaged with said cavities for positioning said control ferrule and said plate to said housing.

* * * * *